US010864526B2

(12) United States Patent
Johnsgard et al.

(10) Patent No.: US 10,864,526 B2
(45) Date of Patent: Dec. 15, 2020

(54) ELECTRODE FOR ELECTROSTATIC PRECIPITATOR GAS SCRUBBING APPARATUS

(71) Applicant: Airgard, Inc., San Jose, CA (US)

(72) Inventors: Mark W. Johnsgard, San Jose, CA (US); Robert T. LoBianco, Sunnyvale, CA (US)

(73) Assignee: Airgard, Inc., San Jose, CA (US)

( * ) Notice: Subject to any disclaimer, the term of this patent is extended or adjusted under 35 U.S.C. 154(b) by 347 days.

(21) Appl. No.: 15/968,736

(22) Filed: May 1, 2018

(65) Prior Publication Data

US 2018/0318845 A1 Nov. 8, 2018

Related U.S. Application Data

(60) Provisional application No. 62/500,964, filed on May 3, 2017.

(51) Int. Cl.

| | |
|---|---|
| ***B03C 3/16*** | (2006.01) |
| ***B03C 3/47*** | (2006.01) |
| ***B03C 3/49*** | (2006.01) |
| ***B03C 3/41*** | (2006.01) |
| ***B03C 3/017*** | (2006.01) |

(52) U.S. Cl.

CPC ..... *B03C 3/16* (2013.01); *B03C 3/017* (2013.01); *B03C 3/41* (2013.01); *B03C 3/47* (2013.01); *B03C 3/49* (2013.01); *B03C 2201/10* (2013.01)

(58) Field of Classification Search

CPC combination set(s) only.

See application file for complete search history.

(56) References Cited

U.S. PATENT DOCUMENTS 1,339,480 A * 5/1920 Schmidt ..... B03C 3/53 95/75
2,740,493 A * 4/1956 Wintermute ..... B03C 3/15 95/64

(Continued)

FOREIGN PATENT DOCUMENTS

DE 1025390 B1 * 3/1958 ..... B03C 3/53
JP 2007021380 A * 2/2007
JP 4759773 B2 * 8/2011

*Primary Examiner* — Christopher P Jones
*Assistant Examiner* — Sonji Turner
(74) *Attorney, Agent, or Firm* — Gard & Kaslow LLP

(57) ABSTRACT

An improved electrode for use in an electrostatic precipitator is disclosed. The electrode comprises a generally rod-shaped conductive central portion, to which are attached a plurality of conductive disc-shaped elements. Each disc-shaped element has a number of sharp points spaced around its circumference and a plurality of openings near its center. The central portion of the central portion passes through the centers of each of the plurality of disc-shaped elements such that the disc-shaped elements are located parallel to one another along the central portion, and may be equally spaced along the central portion. The disc-shaped elements are conical or convex in shape, and oriented with their rims raised above their centers so that any water that collects on them runs out through the openings and down the central portion of the electrode. This greatly reduces or eliminates arcing between the electrode and a collector in the electrostatic precipitator.

18 Claims, 6 Drawing Sheets

(56) References Cited

U.S. PATENT DOCUMENTS 3,744,218 A * 7/1973 Ebert ..... B03C 3/00 96/49
3,765,154 A * 10/1973 Hardt ..... B03C 3/53 96/88
3,890,103 A * 6/1975 Konishi ..... B03C 3/017 422/171
3,958,958 A * 5/1976 Klugman ..... B03C 3/16 95/64
4,194,888 A * 3/1980 Schwab ..... B01D 47/10 95/78
4,247,307 A * 1/1981 Chang ..... B03C 3/40 95/79
4,316,727 A * 2/1982 Hegemann ..... B01D 47/10 96/27
4,957,512 A * 9/1990 Denisov ..... B01D 53/18 95/66
5,395,430 A * 3/1995 Lundgren ..... B03C 3/06 96/83
6,193,782 B1 * 2/2001 Ray ..... B03C 3/16 55/DIG. 38
6,228,148 B1 * 5/2001 Aaltonen ..... B03C 3/15 55/431
7,316,735 B2 * 1/2008 Tomimatsu ..... B03C 3/41 55/DIG. 38
7,597,750 B1 * 10/2009 Krigmont ..... B01D 47/14 96/290
8,029,601 B2 * 10/2011 Franzen ..... B03C 3/41 55/DIG. 38
8,337,600 B2 * 12/2012 Paur ..... B03C 3/025 96/62
8,500,873 B2 * 8/2013 Paur ..... B03C 3/025 96/62
8,888,900 B2 * 11/2014 Seeley ..... B01D 47/14 96/290
9,821,320 B2 * 11/2017 Ellis ..... B01D 53/1456

* cited by examiner

ELECTRODE FOR ELECTROSTATIC PRECIPITATOR GAS SCRUBBING APPARATUS

This application claims priority to Provisional Application No. 62/500,964, filed May 3, 2017, which is incorporated by reference herein in its entirety.

FIELD OF THE INVENTION

The present invention relates generally to control and containment of gases and more specifically to an electrostatic precipitator in a gas scrubbing apparatus.

BACKGROUND OF THE INVENTION

A variety of industrial processes create gas streams that must be scrubbed of contaminants before being released to the outside world. The manufacture of electronics, solar cells, display devices, communications devices, metals, ceramics, and polymers, as well as the processing of chemicals, drugs, and other materials, often requires the use of exhaust gas scrubbers. Scrubbers typically receive a substantially gaseous exhaust stream (sometimes containing fine particles or fine mists) and remove contaminants from the stream before the stream is released to the environment.

Exhaust streams from electronic fabrication processes may include a variety of contaminants, including but not limited to perfluorocarbon (PFC) etch gases such as $SF_6$, $NF_3$, $CF_4$, $C_2F_6$, $C_4F_8$, $COF_2$, and $C_4F_6$. Exhaust streams may also include toxic hydrides such as $AsH_3$, $PH_3$, $P_2H_4$, or $B_2H_6$, pyrophoric or flammable gases such as $SiH_4$, $H_2$, $Si_2H_6$, $GeH_4$, and/or gases such as $WF_6$, $SiF_4$, HCl, $BCl_3$, $Cl_2$, $TiCl_4$, $F_2$, HF, and various chlorosilanes. Other industrial processes may also create toxic or polluting exhaust streams particular to a specific material or manufacturing process.

In such processes, a proportion of the gas supplied to the chamber may be exhausted from the chamber, together with solid and gaseous by-products from the process occurring within the chamber. Further, a process tool may have a plurality of process chambers, each of which may be at respective different stage in a deposition, etching or cleaning process. Therefore, during processing a waste stream may be formed from a combination of the gases exhausted from the chambers that may have various different chemical or particulate compositions.

Thus, before the waste stream is vented into the atmosphere, it is typically treated to remove selected gases and solid particles therefrom. Acid gases such as HF and HCl are often soluble in water, and are commonly removed from a gas stream using a wet scrubber, for example, a packed tower scrubber, in which the acid gases are taken into solution by a scrubbing liquid flowing through the scrubber. Some contaminants are water-reactive, and may or may not dissolve in water, depending upon various conditions. These contaminants may also react with water to form solid reaction products.

Some contaminants are often abated by using heat to break down or combust the contaminant to form water-soluble reaction products. Sometimes, this requires high temperatures. For example, $NF_3$ may be combusted at temperatures above 900 degrees Celsius; $CF_4$ may be broken down at temperatures over 1200 degrees Celsius. Other contaminants such as $SiH_4$ may sometimes be combusted simply by exposing the contaminant to an oxygen source.

The water-insoluble, thermally decomposed contaminants may form reaction products (e.g., HF) that may then be removed by wet scrubbing the reacted gas stream. Other water-insoluble contaminants (e.g., $SiH_4$) may form reaction products that include solid species (e.g., $SiO_2$), when thermally reacted.

Generally, such solid species in a waste stream may be present as fine particles in a liquid phase (e.g., water associated with a scrubber), in the gas phase, deposited on a solid surface, or in other ways. These solid species may also nucleate directly on various surfaces. While the formation of solid reaction products may enable certain removal methods (e.g., filtration), these species may also deposit on and clog various lines, inlets, passages, surfaces, and other aspects of the system, reducing the system's efficiency or stopping its operation.

For gas streams including a variety of contaminants, effective scrubbing may require multiple systems, such as a wet scrubber to remove water-soluble contaminants combined with a combustion chamber to combust water-insoluble contaminants. Even such a combination may not be able to remove all of the particles from a gas stream, particular those under a certain size.

In view of this, it is known, to provide an electrostatic precipitator downstream from the wet scrubber and/or combustion chamber to remove these smaller particles from the waste stream. An electrostatic precipitator typically involves injecting a gas from which particulates are to be removed and water mist into a space between two electrodes (the second electrode is sometimes referred to as a collector). However, in some prior art electrostatic precipitators, some electrode configurations can result in water mist collecting on an electrode such that there is undesirable arcing between the electrodes.

Accordingly, it would be useful to have an improved electrode configuration that prevents water from collecting and causing arcing in an electrostatic precipitator.

SUMMARY OF THE INVENTION

An improved electrode for use in an electrostatic precipitator is disclosed.

One embodiment discloses an electrode assembly for use in an electrostatic precipitator, comprising: a first electrode including a generally tubular conductive portion; and a second electrode, comprising: a rod-shaped conductive central portion located along a longitudinal central axis of the first electrode and having a top end and a bottom end; and a plurality of conductive disc-shaped elements, each disc-shaped element having sharp points spaced around its circumference and a plurality of openings near its center, the central portion of the second electrode passing through the centers of each of the plurality of disc-shaped elements such that the disc-shaped elements are located parallel to one another along the central portion of the second electrode.

Another embodiment discloses an apparatus for treating gas, comprising an electrostatic precipitator section having: a casing having an upper end and a lower end; a gas inlet for receiving gas located toward the lower end of the casing; a gas outlet for exhausting gas located near the upper end of the casing; a first electrode including a generally tubular conductive portion; a second electrode, comprising: a rod-shaped conductive central portion located along a longitudinal central axis of the first electrode; and a plurality of conductive disc-shaped elements, each disc-shaped element having sharp points spaced around its circumference and a plurality of openings near its center, the central portion of the second electrode passing through the centers of each of the plurality of disc-shaped elements such that the disc-shaped elements are located parallel to one another along the central portion of the second electrode; a power supply having a positive terminal connected to the first electrode and a negative terminal connected to the second electrode; a liquid inlet located toward the upper end of the casing for receiving a water spray; and a liquid outlet located toward the lower end of the casing.

DETAILED DESCRIPTION OF THE INVENTION

An improved electrode for use in an electrostatic precipitator is disclosed. In one embodiment, the electrode comprises a generally rod-shaped conductive central portion, to which are attached a plurality of conductive disc-shaped elements. Each disc-shaped element has a number of sharp points spaced around its circumference and a plurality of openings near its center. The central portion of the electrode passes through the centers of each of the plurality of disc-shaped elements such that the disc-shaped elements are located parallel to one another along the central portion, and may be equally spaced along the central portion. The disc-shaped elements are conical or convex in shape, and oriented with their rims raised above their centers so that any water that collects on them runs toward the center of the disc-shaped elements and out through the openings and down the central portion of the electrode.

As noted above, in some prior art electrostatic precipitators, some electrode configurations have disc shaped elements or other shapes that may result in water mist collecting on the electrode. Such collection of water mist can result in arcing between the electrode and the collector (i.e., the second electrode). The increased current that accompanies arcing may cause damage to the high-voltage power supply or other components, and also momentarily reduces operating voltage and thus the particle removal efficiency. It is thus preferable to prevent such arcing if possible.

The present configuration significantly ameliorates this problem since any water mist that collects on a disc shaped element will collect at the bottom of the disc shaped element and run out of one or more of the openings at the bottom of the disc shaped element and down the central portion of the electrode, where it can be drained off without arcing. In the absence of any collected water mist at the edges of disc shaped elements, the chance of arcing between the electrode and the collector is eliminated or at least greatly reduced.

Figure 1:
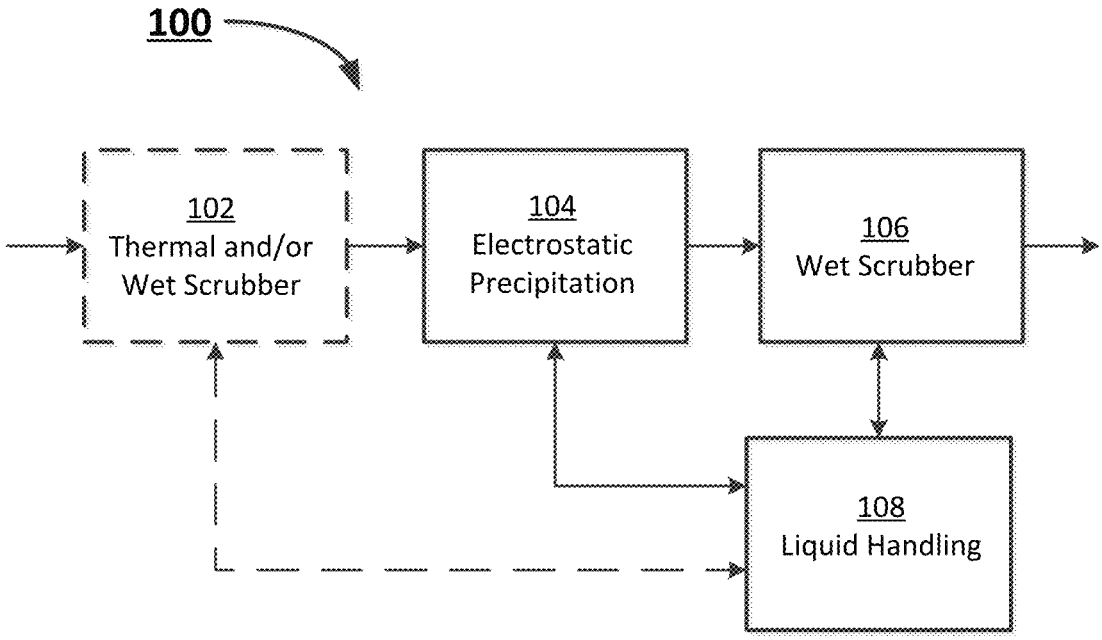
FIG. 1 is a diagrammatic representation of an exemplary system that may be used to perform a multi-step abatement process, according to some embodiments.

As above, one of skill in the art will appreciate that an electrostatic precipitator may be only one part of an abatement system for treating a gas stream containing various contaminants. FIG. 1 is a diagrammatic representation of one exemplary system that may be used to perform a multi-step abatement process, according to some embodiments. Such a system may be particularly useful for abating a mixed-contaminant gas stream, particularly a stream comprising mixtures of water-soluble, water-reactive, and/or water-insoluble contaminants. Abatement system 100 includes an optional thermal burner system and/or wet scrubber 102, an electrostatic precipitation system 104, a wet scrubber 106, and a liquid handling system 108. In other embodiments, the order of the various systems may be altered; for example, in some embodiments it may be desirable to have the gas stream pass through an electrostatic precipitation system first in order to capture excessive dusts and mists resulting from the manufacturing process in use.

Generally, exhaust gas streams may flow through abatement system 100 from left to right as shown. An exhaust gas stream may first be scrubbed of water reactive and/or water-soluble contaminants in a burner system and/or wet scrubber 102. It may be advantageous to use a wet scrubber that removes as many water reactive and/or water-soluble contaminants from the gas stream as possible, as their removal prior to subsequent reaction systems may improve performance of those systems.

The scrubbed gas stream may then be treated in electrostatic precipitation system 104. Generally, electrostatic precipitation system 104 may be used to remove many of the remaining contaminants from the scrubbed gas stream as further described below. The reacted gas stream may then pass to wet scrubber 106. In this example, there may be separate wet scrubbers 102 and 106, although the system may be designed such that a single wet scrubber is used.

For embodiments in which abatement system 100 includes such elements as electrostatic precipitation system 104 and one or more wet scrubbers, substantial amounts of liquid may be needed. In such cases, it may be advantageous to include a separate liquid handling system 108. Liquid handling system 108 may provide liquids to any of wet scrubbers 102 and/or 106 and electrostatic precipitation system 104, as well as handle liquids received from these systems.

As an example, U.S. Pat. No. 8,888,900 shows one embodiment of an abatement system in which a wet scrubber is followed by an electrostatic precipitator.

Figure 2:
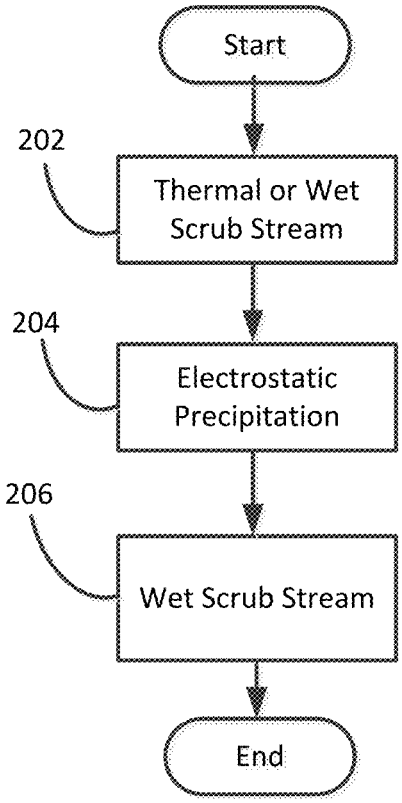
FIG. 2 illustrates several steps in an abatement process according to some embodiments.

FIG. 2 illustrates several steps in an abatement process according to certain embodiments. Some gas streams may be treated by combining several types of abatement apparatus in series and passing the gas stream through each one sequentially. In step 202, a wet scrubber substantially removes water-soluble and/or reactive contaminants from the gas stream. In a preferred embodiment wet scrubber thoroughly scrubs the gas stream (i.e., removes at least 90%, 99%, 99.9%, 99.99%, or even 99.999% of the water-soluble contaminants from the gas stream). In step 204, the scrubbed gas stream is reacted in a reaction system to remove at least a portion of the remaining contaminants. Reaction system 100 may be used for such a step, although other systems capable of reacting such contaminants may also be used. Various embodiments include a reaction system other than reaction system 100, and the use of such systems may be improved when the gas stream has been thoroughly scrubbed of water-soluble contaminants prior to reaction. In step 206, the reacted gas stream is introduced into a wet scrubber (which may be the same or different as the wet scrubber used in step 202). In step 206, the reacted gas stream may be scrubbed of water-soluble reaction products resulting from the reactions of step 204.

Figure 3A:
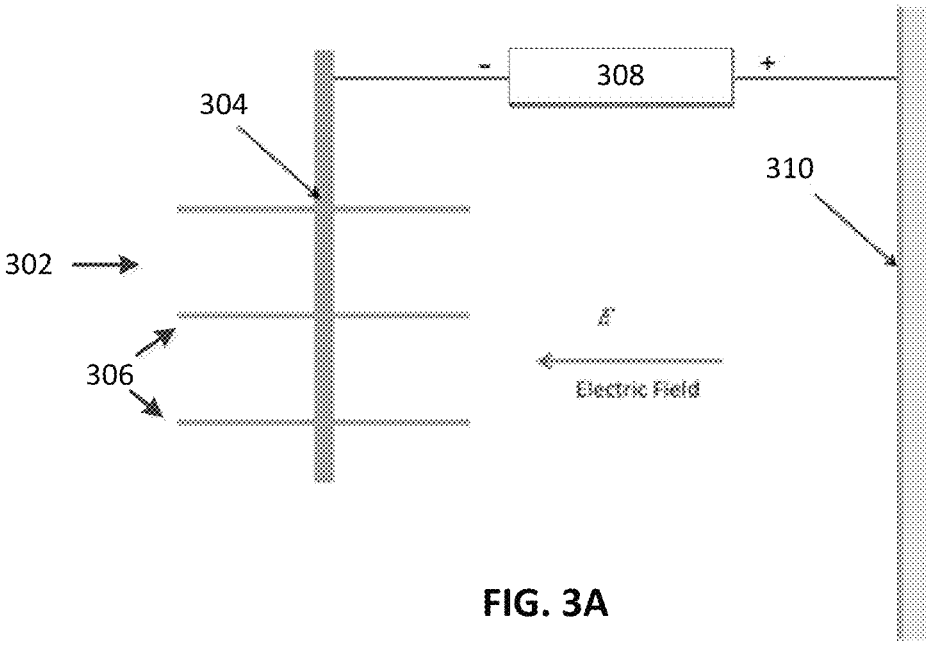
FIGS. 3A to 3D illustrate the general operation of an electrostatic precipitation process according to some embodiments.

FIGS. 3A to 3D illustrate the typical operation of an electrostatic precipitator. FIG. 3A shows the basic components of the electrostatic precipitator. A first electrode 302 includes a longitudinal rod-shaped central portion 304, which connects a plurality of disc shaped elements 306; in some embodiments the spacing between disc shaped elements 306 will be regular, as illustrated, while in other embodiments the spacing may be irregular. As illustrated herein, longitudinal central portion 304 is generally cylindrical, i.e., has a generally circular cross-section, but in some embodiments may have a cross-section that is oval, ovoid, triangular, rectilinear, or even irregular in shape. All such shapes are within the meaning of "rod-shaped" as that term is used herein.

One end of a high-voltage power supply 308 is connected to the first electrode 302, while the other end of power supply 308 is connected to a second electrode (or collector) 310 (with ground return pathways to the power supply if desired), such that an electric field is created in the space between the two electrodes 302 and 310. One of skill in the art will appreciate that acceptable electrode voltages depend upon the spacing between the electrodes, i.e., between the first electrode and the collector. A range of 5,000 to 15,000 volts per centimeter of distance between the electrodes may result in good particle abatement without arcing. As illustrated in FIG. 3A, the negative terminal of power supply 308 is preferably connected to first electrode 302 so that first electrode 302 is a source of electrons, and the positive terminal of power supply 308 is connected to second electrode 310, with the resulting direction of the electric field as shown.

Figure 3B:
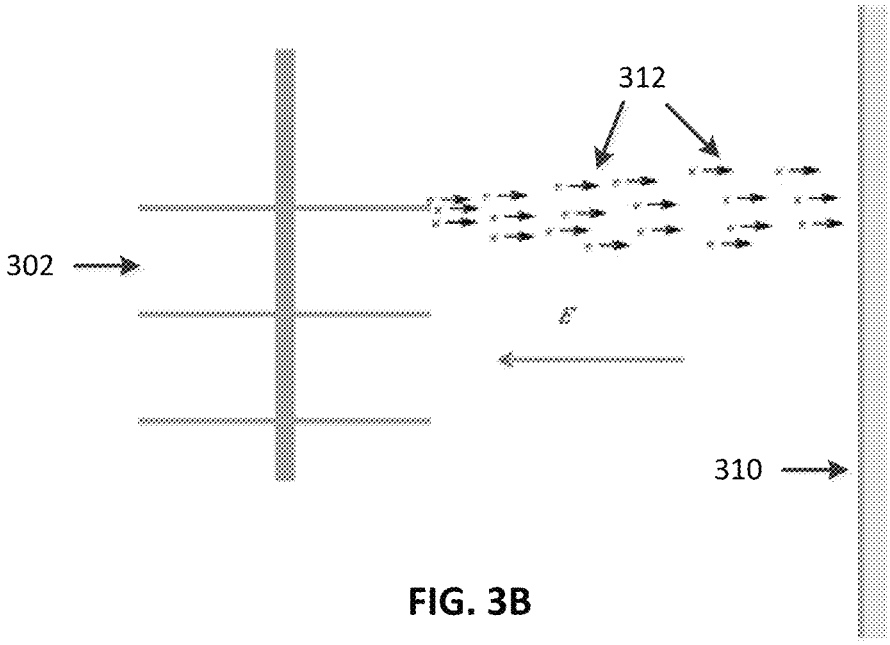

As shown in FIG. 3B, the voltage applied to the electrodes 302 and 310 causes electrons 312 to be ejected from the disc shaped elements 306 on first electrode 302 (particularly from sharp points on the disc shaped elements 306, if such points are present as described below) and to be pushed across to second electrode 310 by the electric field.

Figure 3C:
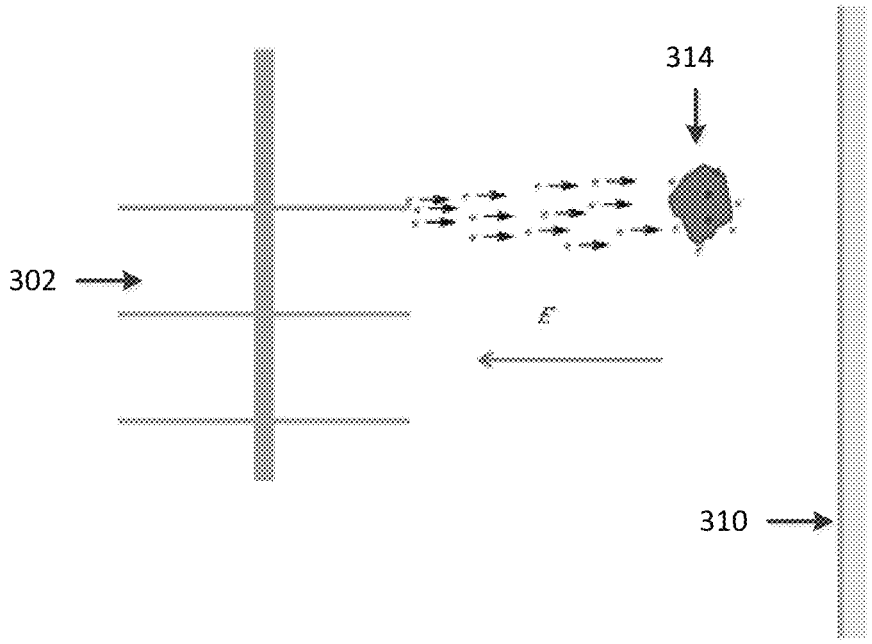

Some of the electrons 312 passing from the disc shaped elements 306 on first electrode 302 to second electrode 310 will strike particles in the gas stream, such as particle 314 as shown in FIG. 3C. Some of the electrons 312 will stick to the particles, giving each such particle a net negative charge.

Figure 3D:
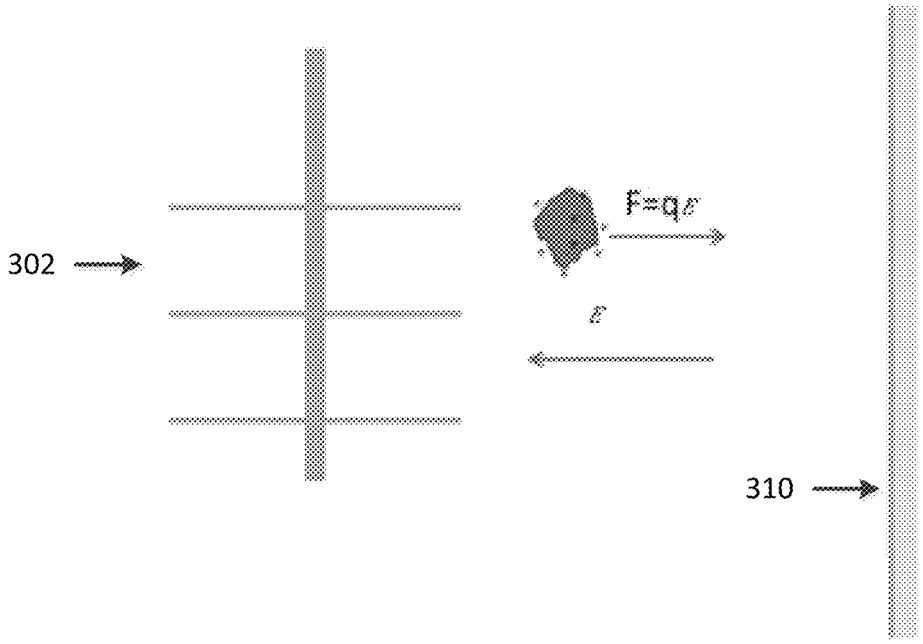

As illustrated in FIG. 3D, the electric field will then exert a force on the now charged particles. The force F on a specific particle is equal to the electric field intensity E times the charge q on that particle. As illustrated here, q is negative, hence the force is in the direction opposite to the field, and toward the electrode or collector 310.

In a wet electrostatic precipitator, the second electrode, or collector, is typically continuously washed with a flow of water. Once the charged particle 314 reaches second electrode 310, the particle 314 is thus washed down to the bottom of second electrode 310 and can then flow out of the electrostatic precipitator.

Figure 4:
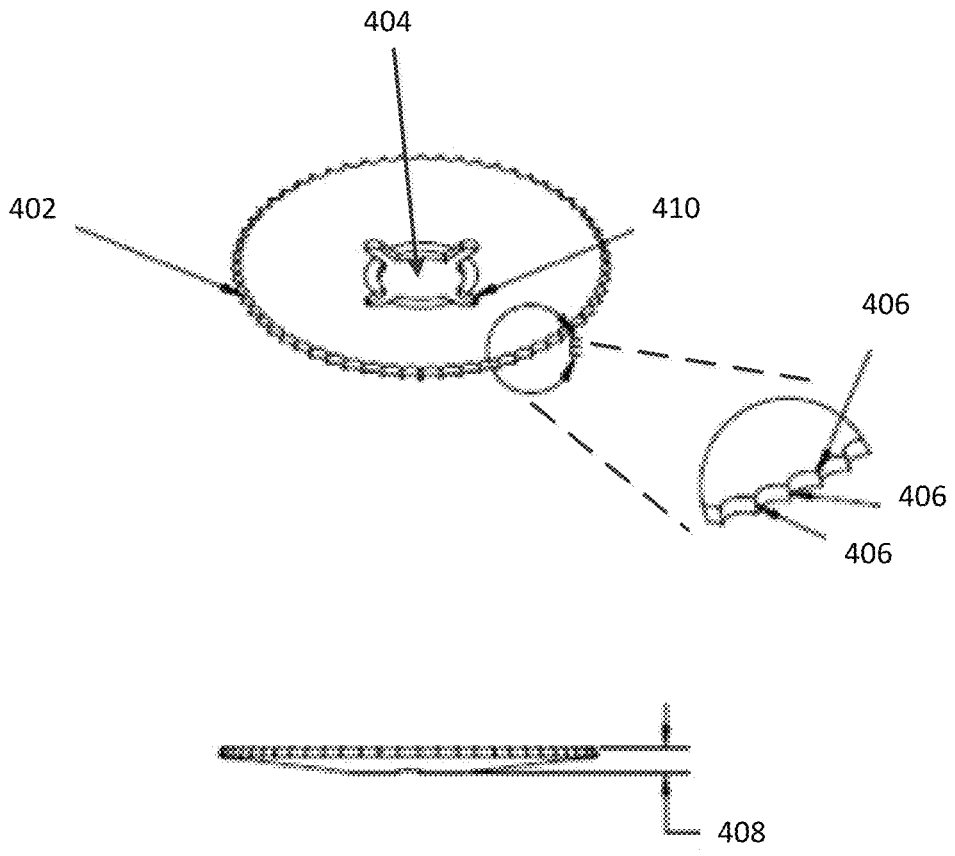
FIG. 4 illustrates a portion of an electrode that may be used in an electrostatic precipitation process according to one embodiment.

FIG. 4 shows a more detailed view of one embodiment of a disc shaped element that may be part of an electrode in an electrostatic precipitator, such as each of disc shaped elements 306 of electrode 302 in FIG. 3A. As illustrated in FIG. 4, the electrode element 402 is disc shaped with a central hole 404 having a circular main portion through which the central portion of a rod shaped electrode, such as longitudinal central portion 304 of electrode 302 in FIG. 3A, will fit. Central hole 404 is here shown as being circular, thus corresponding to a central portion 304 of electrode 302 that has a circular cross-section. It will be appreciated that in other embodiments in which the cross-section of central portion 304 of electrode 302 is not circular, central hole 404 should correspond to the actual cross-section of central portion 304 of electrode 302.

As further shown in FIG. 4, electrode element 402 has a plurality of sharp points 406 spaced around its outer diameter so as to better allow for the ejection of electrons toward the second electrode as described above. In FIG. 4 the points 406 result from a "scalloped" shape having curved indentations in the rim of electrode element 402. However, one of skill in the art will appreciate that any shape resulting in points may be used; for example, in some embodiments the points may be triangular projections from the rim of electrode element 402.

As also shown in FIG. 4, electrode element 402 is slightly concave, conical or "bowl shaped" so as to have a depth 408 between the rim and the center of electrode element 402. In some embodiments, the rim of electrode element 402 is higher than the center by more than 0.05 inches for every inch of radius of electrode element 402, which should be sufficient to cause any collected water to run toward the center of electrode element 402 and prevent the water from dripping off of the rim of electrode element 402 and possibly producing an arc. One of skill in the art will appreciate that other shapes that satisfy the purpose of causing collected water to run to the center of the electrode element 402 may also be used.

Central hole 404 also has a plurality of openings 410 around the circular main portion of central hole 404, so that when the disc shaped electrode is mounted on a central portion of an electrode as in FIG. 3A, these openings are not blocked by the central portion of the electrode. As illustrated in FIG. 4, these openings 410 are slots that extend from the central hole 404 in electrode element 402. Alternatively, there may be extensions of central hole 404 that are shapes other than slots 410, or even holes in electrode element 402 that are separate from, but near, central hole 404. All of these alternatives are included within the meaning of "openings" in electrode element 402 as that term is used herein.

When attached to the central portion of an electrode, the rim of electrode element 402 should be toward the top of the electrostatic precipitator and the center of electrode element 402 toward the bottom of the electrostatic precipitator. This allows fluid from the water mist that collects on electrode element 402 to run to the center of electrode element 402 where it can drain through one or more of the openings 410, and down the central portion of the electrode. As above, this prevents collected water from collecting on or dripping off the rim of electrode element 402, greatly reducing or eliminating arcing, and also allows the collected water to actively rinse the electrode, slowing deposition of any particles on the electrode and removing any previously accumulated matter.

In some embodiments, as is known in the art the electrostatic precipitator may be contained in a vertically oriented generally tubular container, in which first electrode 302 extends down the longitudinal axis of the container, and second electrode 310 is the inner wall of the container. As above, second electrode 310 will be continuously washed with a flow of water.

As shown herein, the tubular container is cylindrical, and thus has a circular cross-section. In other embodiments, the tubular shape may have an oval, ovoid, or rectilinear cross-section, or even an irregularly shaped cross-section. Those of skill in the art, in light of the teachings herein, will appreciate the issues that may arise with such other shapes and the implementation variations required for such other shapes.

When a different treatment method is used before an electrostatic precipitator, the prior treatment method and resulting products may cause certain design decisions to be more desirable. For example, in some embodiments water from a wet scrubber may be used as the flow of water over the second electrode. In some cases, this fluid may contain acids such as HF or HCl, having a pH value less than 1 and thus being corrosive. In such cases the body of the electrostatic precipitator may be made of a corrosion resistant plastic such as PVC, and the water used to flush the collection surface used as the conductor of the second electrode.

In other cases, water from the wet scrubber may contain dissolved CO2 from a prior thermal process. When this water is used to flush the collection surface, it may be desirable to supply deionized water with a very low conductivity to be used as the water mist in the electrostatic precipitator. The dissolved CO2 will partially convert to carbonic acid, which increases the conductivity of the collected water and mist and allows the electrostatic precipitator to remain effective.

As above, it is known to treat a gas stream with a wet scrubber before further treatment with an electrostatic precipitator. In a different embodiment described herein, the sequence is reversed, with treatment of a gas by the electrostatic precipitator prior to treatment by the wet scrubber. The electrostatic precipitator may use the improved electrode described above.

Figure 5:
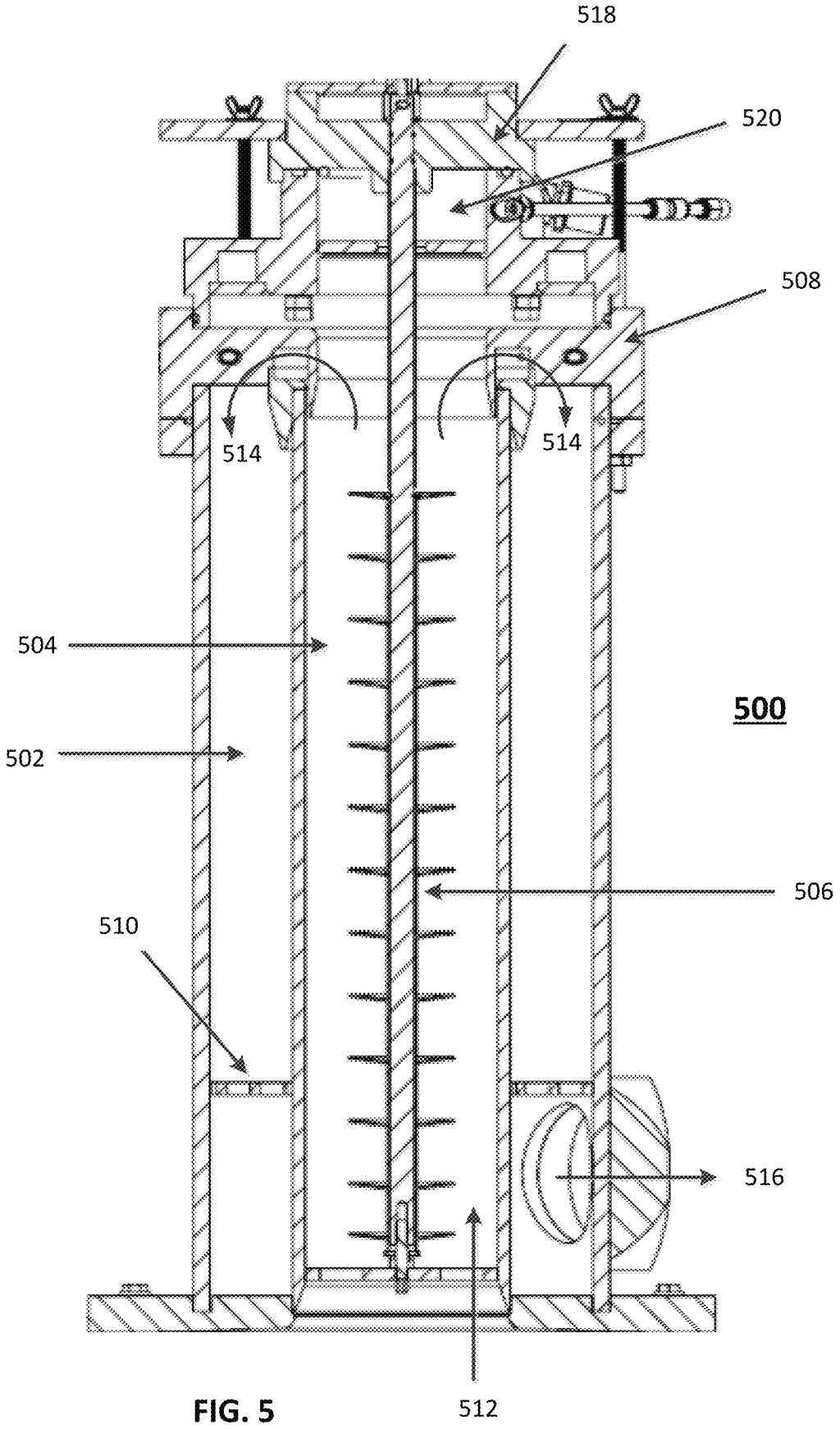
FIG. 5 is a cross-sectional view of an abatement apparatus including an electrostatic precipitator and a wet scrubber according to one embodiment.

FIG. 5 is a cross-sectional view of an abatement apparatus 500 including an electrostatic precipitator and a wet scrubber according to one embodiment. The abatement apparatus 500 includes a packed column wet scrubber 502 located concentric to a central electrostatic precipitator 504, i.e., the precipitator is located in a central column/tube and the scrubber is in a surrounding column or tube, such that the outside wall of the electrostatic precipitator 504 is the inner wall of column scrubber 502. In one embodiment, the first electrode 506 of the electrostatic precipitator 504 is the electrode described above, i.e., an electrode such as electrode 302 of FIG. 3A with a plurality of disc shaped elements such as disc shaped elements 306 of FIG. 3A, each of which may be configured such as shown by element 402 of FIG. 4.

As shown by arrow 512, gas, for example, from a burn chamber (not shown) moves upwards through a sump-supplied, recirculating water spray in the central collection tube of electrostatic precipitator 504 and into a sump-supplied, recirculating water feed ring 508 at the top of the apparatus 500. Here, as shown by arrow 514, the gas reverses direction and flows downwards through fresh water wash packing in the wet scrubber 502 that encircles or surrounds the core assembly of electrostatic precipitator 504. The gas then passes through a packing stop 510 at the bottom of the packed column and, as shown by arrow 516, exits through a removable flanged exhaust to a facility exhaust system.

In some embodiments, the electrostatic precipitator 504 of apparatus 500 may only receive sump-supplied, recirculating water while the wet scrubber 502 may only receive a supply of fresh water. These two different water sources may be physically separate such that the respective liquids are never combined in apparatus 500. As above, the electrostatic precipitator 504 is located concentric to the wet scrubber 502 in apparatus 500, with neither being physically located above the other.

In some embodiments, the connection from the high voltage power supply 518 to the electrostatic precipitator electrode 506 may pass through a chamber 520 which is filled with an inert gas, such as nitrogen, or clean dry air. The gas or clean dry air in the chamber 520 is at a higher pressure than gas in the electrostatic precipitator. A small opening is provided between chamber 520 and the top of the electrostatic precipitator, and the pressure difference between the gas or clean dry air in chamber 520 and gas in the electrostatic precipitator allows the gas or clean dry air to flow only from chamber 520 into the electrostatic precipitator, thus preventing the accumulation of water and/or particles on the connection from high voltage power supply 518.

As above, it is expected that many or most particles will acquire a negative charge and be pulled away from the first electrode of the electrostatic precipitator, such as electrode 506 in FIG. 5. However, there may be some particles that have been stripped of their electrons or are neutrally charged that may be attracted to the negatively charged first electrode 506. Such particles may be deposited on the first electrode 506, reducing its efficiency and/or requiring periodic maintenance to clean first electrode 506. It is desirable that cleaning first electrode 506 be as automatic as possible, so that operating time is not lost and any exposure of workers to contaminants is minimized.

Figure 6:
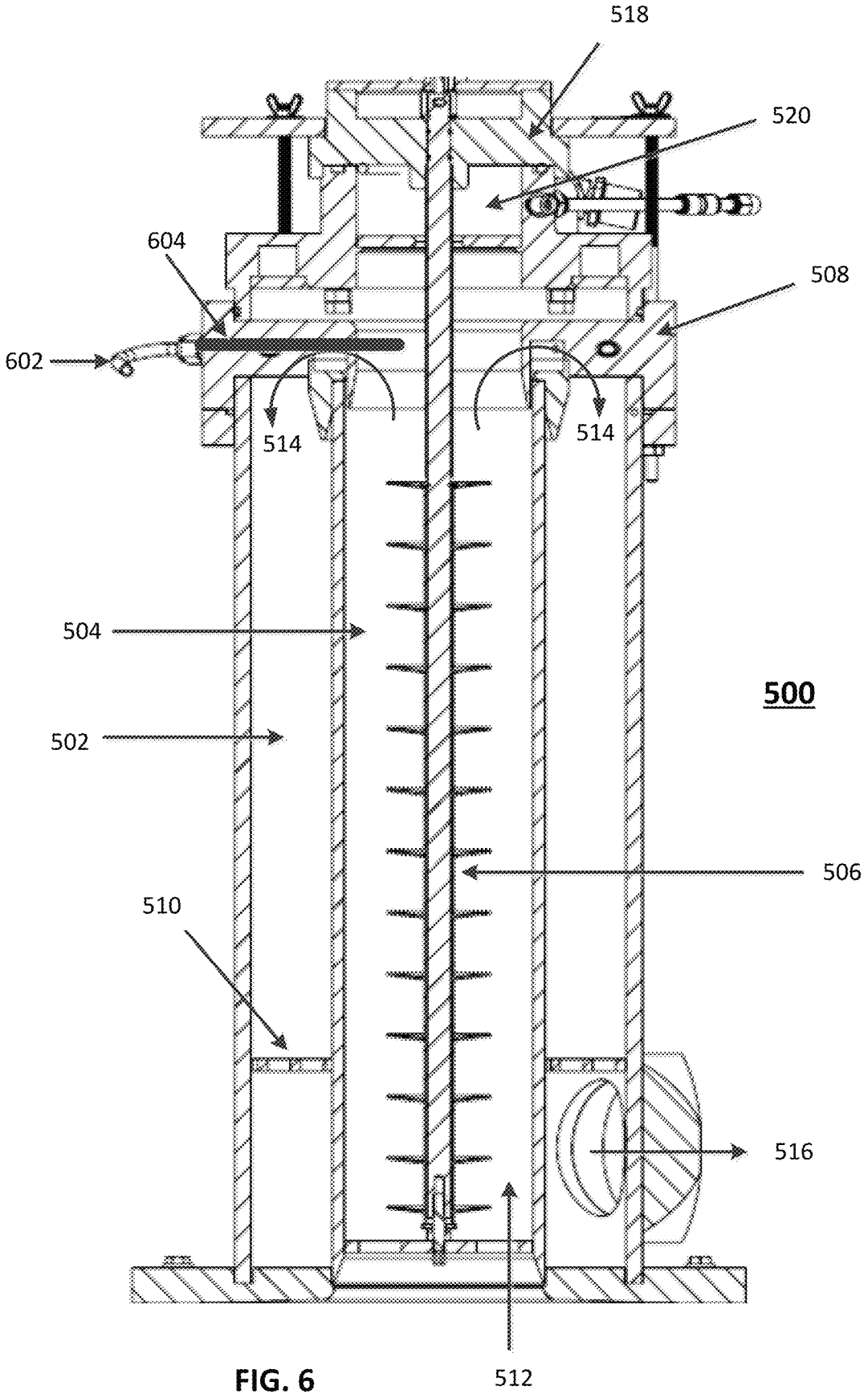
FIG. 6 is a cross-sectional view of an abatement apparatus including an electrostatic precipitator and a wet scrubber according to another embodiment.

To accomplish this, the electrostatic precipitator may be provided with a built in rinsing system which projects a liquid onto first electrode 506 so as to rinse away any material that has been so deposited. In one embodiment a single hole is used to direct a water stream to the top of first electrode 506 that rinses the accumulated material off of the central portion of first electrode 506 and then cascades down, sequentially rinsing the individual disc shaped elements 306. FIG. 6 shows the electrostatic precipitator 500 of FIG. 5, and now includes a water input 602 connected to a conduit 604 having an outlet hole within the electrostatic precipitator that may be used to provide a water stream to first electrode 506.

In other embodiments, a conduit with multiple outlet holes may be used; the holes may be aligned parallel to the longitudinal axis of first electrode 506, so as to rinse the entire electrode at once from multiple directions, or alternatively may rinse various sections of first electrode 506 sequentially from one or more directions. In still further embodiments, a spiral manifold with a plurality of water nozzles may be used; in some cases the spacing of the water nozzles may approximate the pitch of the disc shaped elements 306. Alternatively, a plurality of cylindrical or toroid shaped manifolds may be used. In light of the teachings herein, those of skill in the art will be able to determine which configuration will provide the best cleaning results in a given case.

The amount of water used to rinse first electrode 506 should be adequate to wash all of disc shaped elements 306, thus providing cleaning of all of first electrode 506. The water may be any water; for example, it could be fresh city water, scrubber sump water, or sump water or city water that has been treated with a cleaner. The cleaner may be acid based, alkaline, or may include a plurality of like or different chemicals or compounds or mixtures that speed the removal of deposits.

In various embodiments, the rinsing operation may be automated to occur at predetermined time intervals. In other embodiments, measured operating parameters of the system such as voltage, current, remaining particles after precipitation or other parameters, may indicate that performance of the electrostatic precipitator has fallen below some predetermined level, causing rinsing to occur. Alternatively, rinsing may be manually commenced. Those of skill in the art will appreciate many other control methods and techniques that may be used to control a rinse cycle.

It will be appreciated that the water used in rinsing can cause both shorting and/or an arc since the water stream provides a pathway to ground. This may be mitigated by decreasing the voltage to first electrode 506 during the rinsing operation, although this may also cause the particle scrubbing action of the electrostatic precipitator to decrease. Since the rinsing will preferably be of relatively short duration, the decrease in particle scrubbing action should not be excessive. Alternatively, the electrode power supply may be shut off allowing the rinse operation to proceed without a charge being supplied to the electrode.

In some embodiments, the rinse system will include a pressurized water supply and an automated shutoff valve. The water flow may be either variable or predetermined; depending upon the process type, a flow of 0.1 to 0.5 gallons per minute may be used, but higher flows may be necessary for certain types of deposited minerals. Rinsing type may be as short as 2 seconds or as long as several minutes, depending upon the chemistry of the rinsing water and the characteristics of the deposited material.

Once a rinse is completed, time may be provided to allow first electrode 506 to dry. Where first electrode 506 is on at reduced voltage during the rinse cycle, the voltage may be gradually increased as rinse water drips off first electrode 506. In higher voltage systems where power to first electrode 506 is turned off during rinsing, power may be turned on in as little as one second or as long as several minutes after rinsing is complete. In other embodiments, power may be pulsed during the drying time to cause droplets to be pushed off first electrode 506, although possibly with some resulting arcing. In still other embodiments, a hot nitrogen gas stream may be passed over first electrode 506 after rinsing to accelerate the drying time.

Lab results show such an electrostatic precipitator can reduce the particle matter coming from the abatement system by more than 99.9% of the original particle content of the gas. Current abatement systems produce particle output loads of 30 grams per hour or more depending on the makeup of the incoming gases. A reduction of the particle output load to less than 0.1 grams per hour has been measured by using this process.

The disclosed system and method has been explained above with reference to several embodiments. Other embodiments will be apparent to those skilled in the art in light of this disclosure. Certain aspects of the described method and apparatus may readily be implemented using configurations or steps other than those described in the embodiments above, or in conjunction with elements other than or in addition to those described above. It will also be apparent that in some instances the order of the processes described herein may be altered without changing the overall result of the performance of all of the described processes, as well as the possible use of different types of air scrubbing systems.

For example, one of skill in the art will appreciate that wet scrubbers before or after an electrostatic precipitator may or may not have packing, may use different sources of water, such as water from the electrostatic precipitator, clean municipal water, etc., and may be irrigated in different ways, such as by a continuous stream of water, spray nozzles only, etc.

It should also be appreciated that the described method and apparatus can be implemented in numerous ways, including as a process, an apparatus, or a system. The methods described herein may be implemented by program instructions for instructing a processor to perform such methods, and such instructions recorded on a computer readable storage medium such as a hard disk drive, floppy disk, optical disc such as a compact disc (CD) or digital versatile disc (DVD), flash memory, etc. It may be possible to incorporate some methods into hard-wired logic if desired. It should be noted that the order of the steps of the methods described herein may be altered and still be within the scope of the disclosure.

It is to be understood that the examples given are for illustrative purposes only and may be extended to other implementations and embodiments with different conventions and techniques. While a number of embodiments are described, there is no intent to limit the disclosure to the embodiment(s) disclosed herein. On the contrary, the intent is to cover all alternatives, modifications, and equivalents apparent to those familiar with the art.

In the foregoing specification, the invention is described with reference to specific embodiments thereof, but those skilled in the art will recognize that the invention is not limited thereto. Various features and aspects of the above-described invention may be used individually or jointly. Further, the invention can be utilized in any number of environments and applications beyond those described herein without departing from the broader spirit and scope of the specification. The specification and drawings are, accordingly, to be regarded as illustrative rather than restrictive. It will be recognized that the terms "comprising," "including," and "having," as used herein, are specifically intended to be read as open-ended terms of art.

What is claimed is:

1. An electrode assembly for use in an electrostatic precipitator, comprising:

a first electrode including a generally tubular conductive portion; and a second electrode, comprising a rod-shaped conductive central portion located along a longitudinal central axis of the first electrode and having a top end and a bottom end, and a plurality of conductive disc-shaped elements, each disc-shaped element having sharp points spaced around a circumference of the disc-shaped element and a plurality of openings near a center of the disc-shaped element, the central portion of the second electrode passing through the centers of the plurality of disc-shaped elements such that the disc-shaped elements are located parallel to one another along the central portion of the second electrode, and wherein the sharp points of the disc-shaped elements are raised toward the top end of the central portion of the second electrode from the centers of the plurality of disc-shaped elements by at least 0.05 inches for each inch of radius of the disc-shaped elements.

2. The electrode assembly of claim 1 wherein the disc-shaped elements have a concave shape, with a concave side facing toward the top end of the central portion of the second electrode.

3. The electrode assembly of claim 1 wherein the disc-shaped elements have a conical shape, with an apex of the conical shape facing toward the bottom end of the central portion of the second electrode.

4. The electrode assembly of claim 1 wherein the disc-shaped elements are located equally spaced along the central portion of the second electrode.

5. An apparatus for treating gas, comprising an electrostatic precipitator section having:

a casing having an upper end and a lower end;

a gas inlet for receiving gas located toward the lower end of the casing;

a gas outlet for exhausting gas located near the upper end of the casing;

a first electrode including a generally tubular conductive portion;

a second electrode, comprising a rod-shaped conductive central portion located along a longitudinal central axis of the first electrode and having a top end and a bottom end, and a plurality of conductive disc-shaped elements, each disc-shaped element having sharp points spaced around a circumference of the disc-shaped element and a plurality of openings near a center of the disc-shaped element, the central portion of the second electrode passing through the centers of the plurality of disc-shaped elements such that the disc-shaped elements are located parallel to one another along the central portion of the second electrode, and wherein the sharp points of the disc-shaped elements are raised toward the top end of the central portion of the second electrode from the centers of the plurality of disc-shaped elements by at least 0.05 inches for each inch of radius of the disc-shaped elements;

a power supply having a positive terminal connected to the first electrode and a negative terminal connected to the second electrode;

a liquid inlet located toward the upper end of the casing for receiving a water spray; and a liquid outlet located toward the lower end of the casing.

6. The apparatus of claim 5 wherein the disc-shaped elements have a concave shape, with a concave side facing toward the top end of the central portion of the second electrode.

7. The apparatus of claim 5 wherein the disc-shaped elements have a conical shape, with an apex of the conical shape facing toward the bottom end of the central portion of the second electrode.

8. The apparatus of claim 5 wherein the disc-shaped elements are located equally spaced along the central portion of the second electrode.

9. An apparatus for treating gas, comprising an electrostatic precipitator section having:

a casing having an upper end and a lower end;

a gas inlet for receiving gas located toward the lower end of the casing;

a gas outlet for exhausting gas located near the upper end of the casing;

a first electrode including a generally tubular conductive portion;

a second electrode, comprising a rod-shaped conductive central portion located along a longitudinal central axis of the first electrode and having a top end and a bottom end, and a plurality of conductive disc-shaped elements, each disc-shaped element having sharp points spaced around a circumference of the disc-shaped element and a plurality of openings near a center of the disc-shaped element, the central portion of the second electrode passing through the centers of the plurality of disc-shaped elements such that the disc-shaped elements are located parallel to one another along the central portion of the second electrode;

a power supply having a positive terminal connected to the first electrode and a negative terminal connected to the second electrode;

a liquid inlet located toward the upper end of the casing for receiving a water spray;

a liquid outlet located toward the lower end of the casing; and a packed column scrubber section positioned within the casing and concentric to the electrostatic precipitator section, the packed column scrubber section having a first inlet located near the top of the casing for receiving gas from the outlet of the electrostatic precipitator section and a second inlet for receiving water.

10. An apparatus for treating gas, comprising an electrostatic precipitator section having:

a casing having an upper end and a lower end;

a gas inlet for receiving gas located toward the lower end of the casing;

a gas outlet for exhausting gas located near the upper end of the casing;

a first electrode including a generally tubular conductive portion;

a second electrode, comprising a rod-shaped conductive central portion located along a longitudinal central axis of the first electrode and having a top end and a bottom end, and a plurality of conductive disc-shaped elements, each disc-shaped element having sharp points spaced around a circumference of the disc-shaped element and a plurality of openings near a center of the disc-shaped element, the central portion of the second electrode passing through the centers of the plurality of disc-shaped elements such that the disc-shaped elements are located parallel to one another along the central portion of the second electrode;

a power supply having a positive terminal connected to the first electrode and a negative terminal connected to the second electrode;

a liquid inlet located toward the upper end of the casing for receiving a water spray;

a liquid outlet located toward the lower end of the casing;

a second liquid inlet; and a conduit configured to receive liquid from the second liquid inlet and direct the liquid onto the central portion of the second electrode.

11. The apparatus of claim 10 wherein the conduit has a plurality of outlet holes configured direct liquid from the second liquid inlet onto the central portion of the second electrode from multiple directions.

12. An apparatus for treating gas, comprising an electrostatic precipitator section having:

a casing having an upper end and a lower end;

a gas inlet for receiving gas located toward the lower end of the casing;

a gas outlet for exhausting gas located near the upper end of the casing;

a first electrode including a generally tubular conductive portion;

a second electrode, comprising a rod-shaped conductive central portion located along a longitudinal central axis of the first electrode and having a top end and a bottom end, and a plurality of conductive disc-shaped elements, each disc-shaped element having sharp points spaced around a circumference of the disc-shaped element and a plurality of openings near a center of the disc-shaped element, the central portion of the second electrode passing through the centers of the plurality of disc-shaped elements such that the disc-shaped elements are located parallel to one another along the central portion of the second electrode;

a power supply having a positive terminal connected to the first electrode and a negative terminal connected to the second electrode;

a liquid inlet located toward the upper end of the casing for receiving a water spray;

a liquid outlet located toward the lower end of the casing;

a second liquid inlet; and a conduit configured to receive liquid from the second liquid inlet and having a plurality of outlet holes configured to direct the liquid onto each of the plurality of disc shaped elements.

13. The apparatus of claim 9 wherein the electrostatic precipitator section and the packed column scrubber section are each tubular, such that the electrostatic precipitator section is located in a central tubular portion of the casing and the packed column scrubber section is in a surrounding tubular portion of the casing.

14. The apparatus of claim 13 wherein the disc-shaped elements have a concave shape, with a concave side facing toward the top end of the central portion of the second electrode.

15. The apparatus of claim 13 wherein the disc-shaped elements have a conical shape, with an apex of the conical shape facing toward the bottom end of the central portion of the second electrode.

16. The apparatus of claim 13 wherein the sharp points of the disc-shaped elements are raised toward the top end of the central portion of the second electrode from the centers of the disc-shaped elements by at least 0.05 inches for each inch of radius of the disc-shaped elements.

17. The apparatus of claim 13 wherein the disc-shaped elements are located equally spaced along the central portion of the second electrode.

18. The apparatus of claim 5 further comprising a chamber filled with an inert gas or clean dry air and located between the power supply and the second electrode, wherein the negative terminal of the power supply is connected to the second electrode through the chamber.

* * * * *